US010128074B2

(12) United States Patent
Lorenzon et al.

(10) Patent No.: US 10,128,074 B2
(45) Date of Patent: Nov. 13, 2018

(54) PYROTECHNIC CIRCUIT BREAKER HAVING AN IMPROVED STRUCTURE FOR ACCOMMODATING A BUS BAR, AND ASSEMBLY METHOD THEREOF

(71) Applicant: AIRBUS SAFRAN LAUNCHERS SAS, Paris (FR)

(72) Inventors: Romain Lorenzon, Eysines (FR); Jean-Paul Nadeau, Ollioules (FR); Frédéric Marlin, Saint Medard en Jalles (FR)

(73) Assignee: Arianegroup SAS, Paris (FR)

( * ) Notice: Subject to any disclaimer, the term of this patent is extended or adjusted under 35 U.S.C. 154(b) by 0 days.

(21) Appl. No.: 15/506,926

(22) PCT Filed: Sep. 8, 2015

(86) PCT No.: PCT/EP2015/070511

§ 371 (c)(1),
(2) Date: Feb. 27, 2017

(87) PCT Pub. No.: WO2016/038043

PCT Pub. Date: Mar. 17, 2016

(65) Prior Publication Data

US 2017/0263402 A1 Sep. 14, 2017

(30) Foreign Application Priority Data

Sep. 9, 2014 (EP) ..... 14306381

(51) Int. Cl.

| | |
|---|---|
| ***H01H 39/00*** | (2006.01) |
| ***H01H 11/00*** | (2006.01) |
| ***H01H 71/02*** | (2006.01) |

(52) U.S. Cl.

CPC ..... *H01H 39/006* (2013.01); *H01H 11/00* (2013.01); *H01H 71/025* (2013.01)

(58) Field of Classification Search

CPC ..... H01H 39/006; H01H 71/025; H01H 11/00
USPC ..... 337/157
See application file for complete search history.

(56) References Cited

U.S. PATENT DOCUMENTS

| | | | | |
|---|---|---|---|---|
| 2,936,331 | A * | 5/1960 | Sillers | H02G 5/025 174/171 |
| 3,003,045 | A * | 10/1961 | Tichenor | H01H 3/00 200/296 |
| 3,277,255 | A * | 10/1966 | Mattsson | F42B 3/006 200/61.08 |
| 3,393,605 | A * | 7/1968 | Parnell | B63G 7/02 30/180 |

(Continued)

OTHER PUBLICATIONS

International Search Report issued in corresponding International App. No. PCT/EP2015/070511 dated Nov. 26, 2015 (3 pages).

*Primary Examiner* — Anatoly Vortman
(74) *Attorney, Agent, or Firm* — Bookoff McAndrews, PLLC

(57) ABSTRACT

A pyrotechnic circuit breaker ,comprising a body, an igniter, a piston a bus bar, wherein the piston comprises a cutting edge and is adapted to move along a normal direction from a raised position to a lowered position to cut a portion of the bus bar, thereby separating the bus bar into two distinct portions in order to break the electrical conduction of the bus bar.

7 Claims, 7 Drawing Sheets

(56) References Cited

U.S. PATENT DOCUMENTS

| | | | | | |
|---|---|---|---|---|---|
| 3,848,100 | A * | 11/1974 | Kozorezov | H01H 39/006 | 200/61.08 |
| 3,873,786 | A * | 3/1975 | Lagofun | B23D 15/145 | 200/61.08 |
| 4,224,487 | A * | 9/1980 | Simonsen | H01H 39/006 | 200/61.08 |
| 5,227,587 | A * | 7/1993 | Paterek | H01B 17/305 | 174/151 |
| 5,535,842 | A * | 7/1996 | Richter | B60K 28/14 | 180/271 |
| 5,877,563 | A * | 3/1999 | Krappel | H01H 39/006 | 180/271 |
| 6,194,988 | B1 * | 2/2001 | Yamaguchi | H01H 39/006 | 180/279 |
| 7,078,635 | B2 * | 7/2006 | Kordel | H01H 39/006 | 200/61.08 |
| 7,123,124 | B2 * | 10/2006 | Caruso | H01H 39/006 | 200/61.08 |
| 7,205,879 | B2 * | 4/2007 | Kordel | H01H 39/006 | 337/157 |
| 7,239,225 | B2 * | 7/2007 | Tirmizi | H01H 39/006 | 337/157 |
| 7,511,600 | B2 * | 3/2009 | Von Behr | H01H 39/006 | 200/61.08 |
| 9,153,402 | B2 * | 10/2015 | Ukon | H01H 39/006 | |
| 9,236,208 | B2 * | 1/2016 | Ukon | H01H 39/006 | |
| 9,419,424 | B2 * | 8/2016 | Karnbach | H02G 5/025 | |
| 2004/0221638 | A1 | 11/2004 | Brede et al. | | |
| 2010/0218659 | A1 * | 9/2010 | Ukon | H01H 39/006 | 83/639.1 |
| 2013/0056344 | A1 | 3/2013 | Borg | | |
| 2017/0263403 | A1 * | 9/2017 | Marlin | H01H 39/006 | |

* cited by examiner

PYROTECHNIC CIRCUIT BREAKER HAVING AN IMPROVED STRUCTURE FOR ACCOMMODATING A BUS BAR, AND ASSEMBLY METHOD THEREOF

CROSS-REFERENCE TO RELATED APPLICATIONS

This application is the U.S. national phase entry under 35 U.S.C. § 371 of International Application No. PCT/EP2015/070511, filed on Sep. 8, 2015, which claims priority to European Patent Application No. 14306381.6, filed on Sep. 9, 2014, the entireties of which are herein incorporated by reference.

TECHNICAL FIELD

The application relates to the field of pyrotechnic circuit breakers.

BACKGROUND OF THE INVENTION

Pyrotechnic circuit breakers are widely used for disabling an electric circuit, for instance in response to abnormal conditions of use.

Conventional pyrotechnic circuit breakers use a bus bar acting as a conducting element, which can be cut or broken along its transverse direction into two distinct parts by a piston in order to break open the circuit by stopping the electric conduction between the two parts of the bus bar. In the present text, we will refer to the cutting of the bus bar by the piston, to designate either its cutting or its breaking by the piston. Documents US 2010/218659 and US 2013/056344 disclose such known pyrotechnic circuit breakers.

In such pyrotechnic circuit breakers, a recurring issue resides in the assembly of the bus bar, which is usually integrated during the assembly of the pyrotechnic circuit breakers, which are provided as a whole together with their associated bus bar by overmoulding or bolting components around the bus bar.

Furthermore, an additional recurring issue resides in the compatibility of the body of the circuit breaker with various models of bus bar. Conventional circuit breakers are indeed provided with specific bus bar, thereby preventing their use with bus bars that have distinct dimensions such as thickness and width.

SUMMARY OF THE INVENTION

The invention aims at responding at least partially to this problematic, and therefore provides a pyrotechnic circuit breaker, comprising a body , an igniter, a piston and a bus bar, wherein the piston and the bus bar are adapted to be accommodated within the body, and wherein the piston comprises a cutting edge and is adapted to move along a normal direction from a raised position to a lowered position to cut a portion of the bus bar, thereby separating the bus bar into two distinct portions in order to break the electrical conduction of the bus bar, wherein the body comprises a longitudinal slot arranged through a longitudinal direction of the body, perpendicular to the normal direction wherein the bus bar and the longitudinal slot are configured so that the bus bar can be slidably inserted within the insertion slot, characterized in that the pyrotechnic circuit breaker comprises a drawer adapted to be slidably inserted within the longitudinal slot of the body, so that once inserted in the body, the drawer and the body define the insertion slot through the body where the bus bar is slidably inserted.

The drawer typically comprises engagement means adapted to prevent further displacement of the drawer once it is positioned within the opening of the body.

The drawer and the bus bar can also comprise indexation means, adapted to engage the bus bar and the drawer once inserted within the body.

According to a preferred embodiment of the invention, the drawer comprises a receiving groove configured to allow the movement of the cutting edge of the piston through the bus bar, and wherein the receiving groove and the piston are configured so that when the piston moves and reaches its lowered position, the cutting edge of the piston is in continuous contact with a surface of the receiving groove.

Said receiving groove has for instance a triangular shape defining two transversal surfaces of the receiving groove, so that the cutting edge of the piston comes into continuous contact with one of these transversal surfaces when the piston is in its lowered position.

The receiving groove can be designed with other shapes and cross surfaces that are advantageously adapted to the shape of the cutting edge of the piston.

The bus bar comprises engagement means adapted to prevent further displacement once it is positioned within the longitudinal slot of the body.

The invention also relates to a method for assembling a pyrotechnic circuit breaker comprising the steps of:

- inserting a drawer within a longitudinal slot of a body of the pyrotechnic circuit breaker, so as to define an insertion slot between the body and the drawer, and then
- inserting a bus bar through the body of the pyrotechnic circuit breaker.

This method typically further comprises a preliminary step of inserting an igniter and a piston within an inner cavity of the body.

PRESENTATION OF THE DRAWINGS

Other features, aims and advantages of the invention will be detailed in the following description, which is purely illustrative and should not be interpreted in a limiting way, and which should be read in view of the enclosed drawings, wherein:

FIGS. 1 and 2 disclose two views of a pyrotechnic circuit breaker according to an aspect of the invention, respectively an assembled view and an exploded view;

Figure 5:
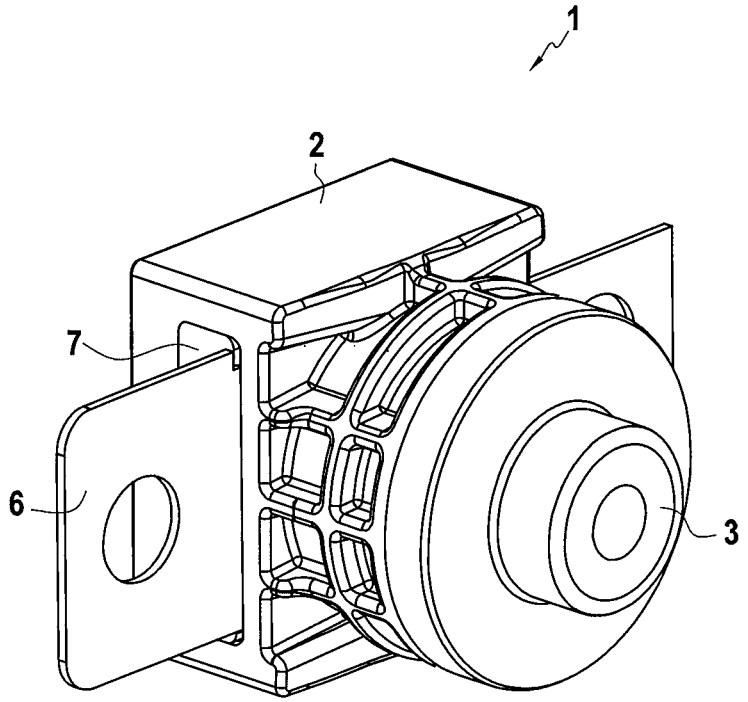
Figure 7:
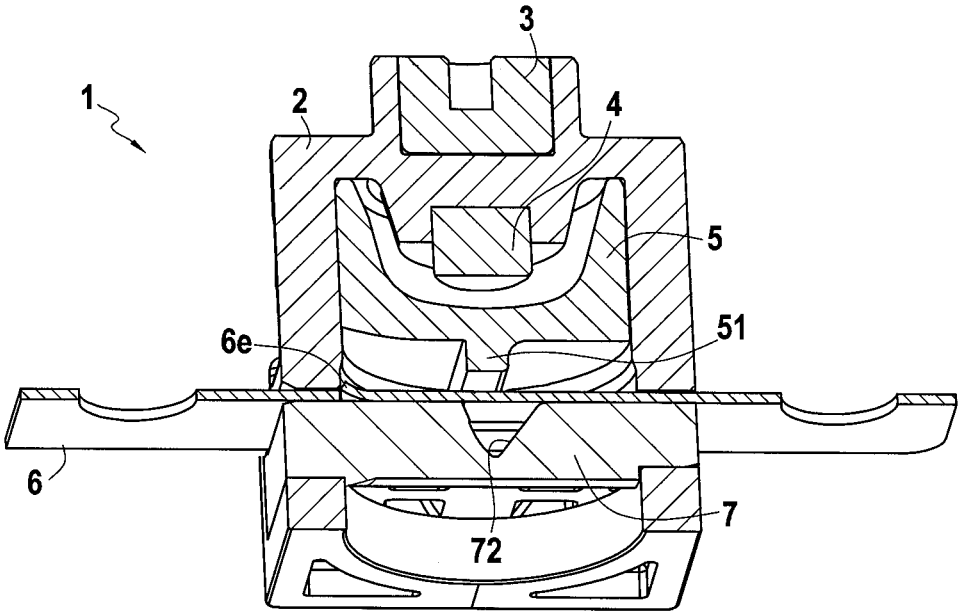
Figure 6:
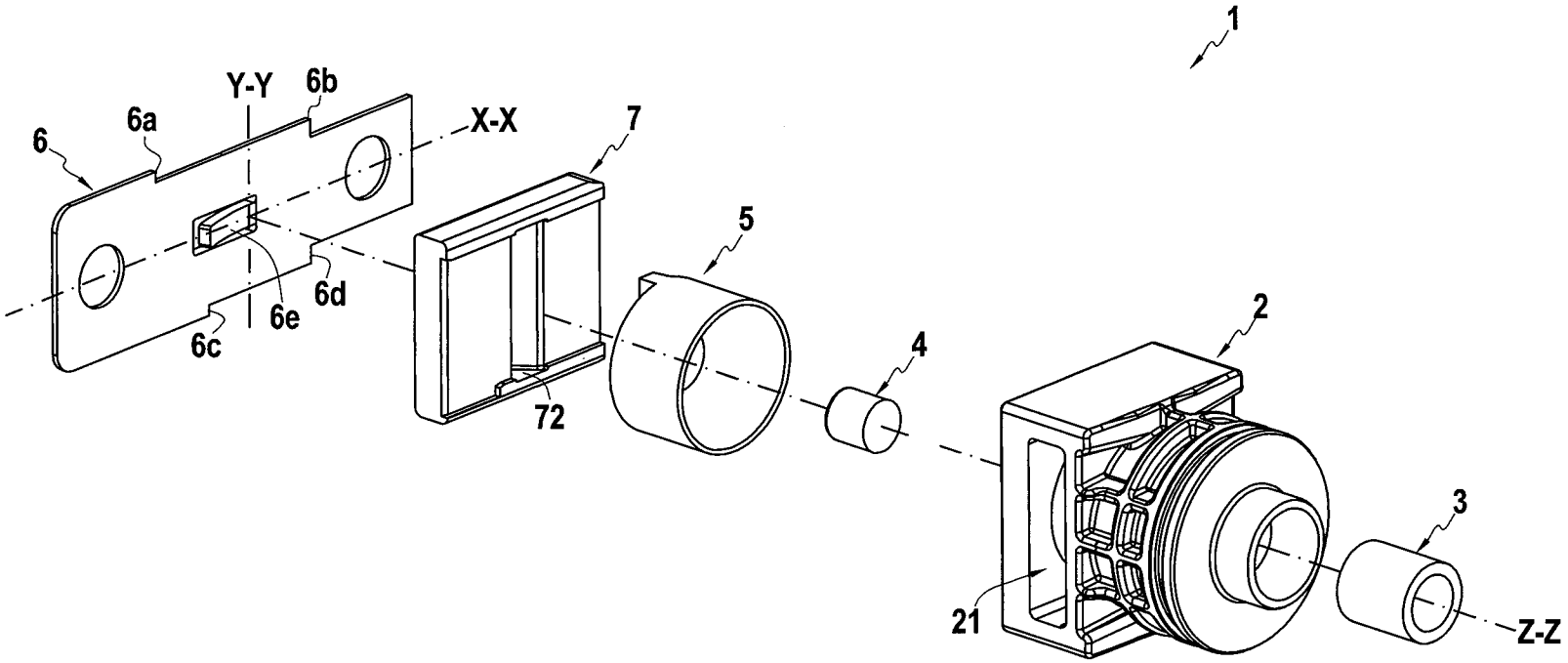
Figure 8:
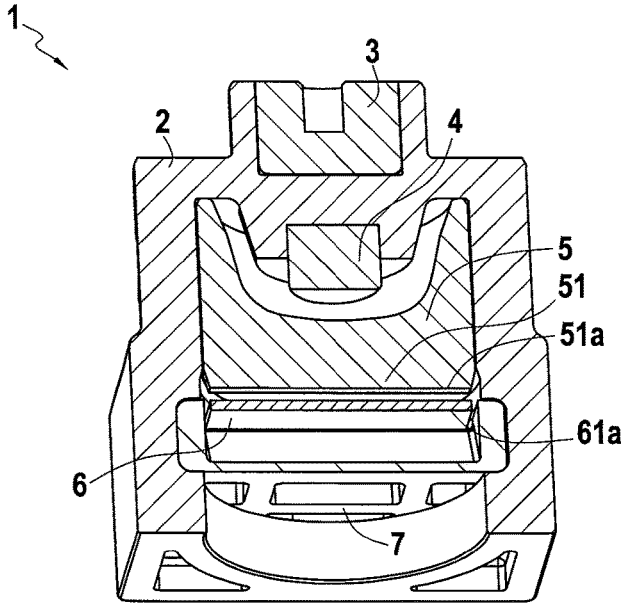
Figure 9:
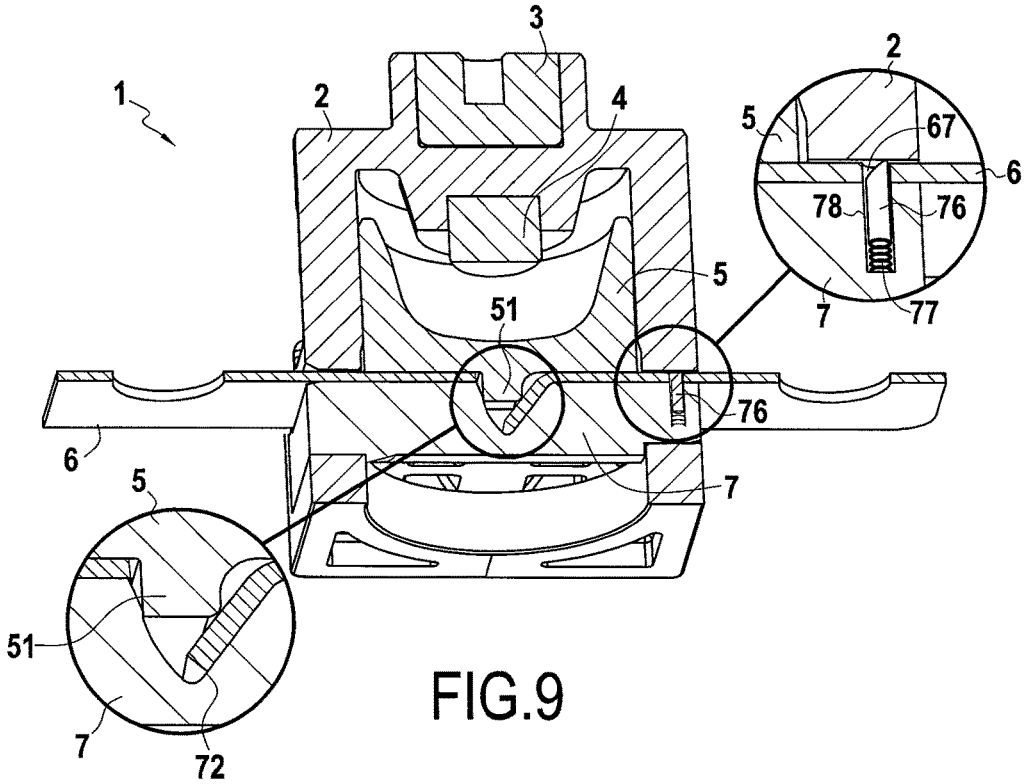
Figure 10:
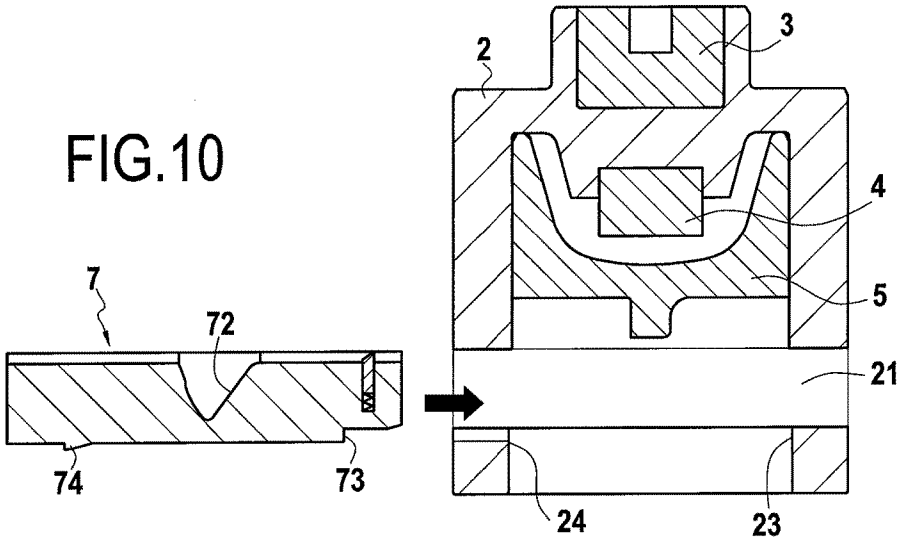
Figure 11:
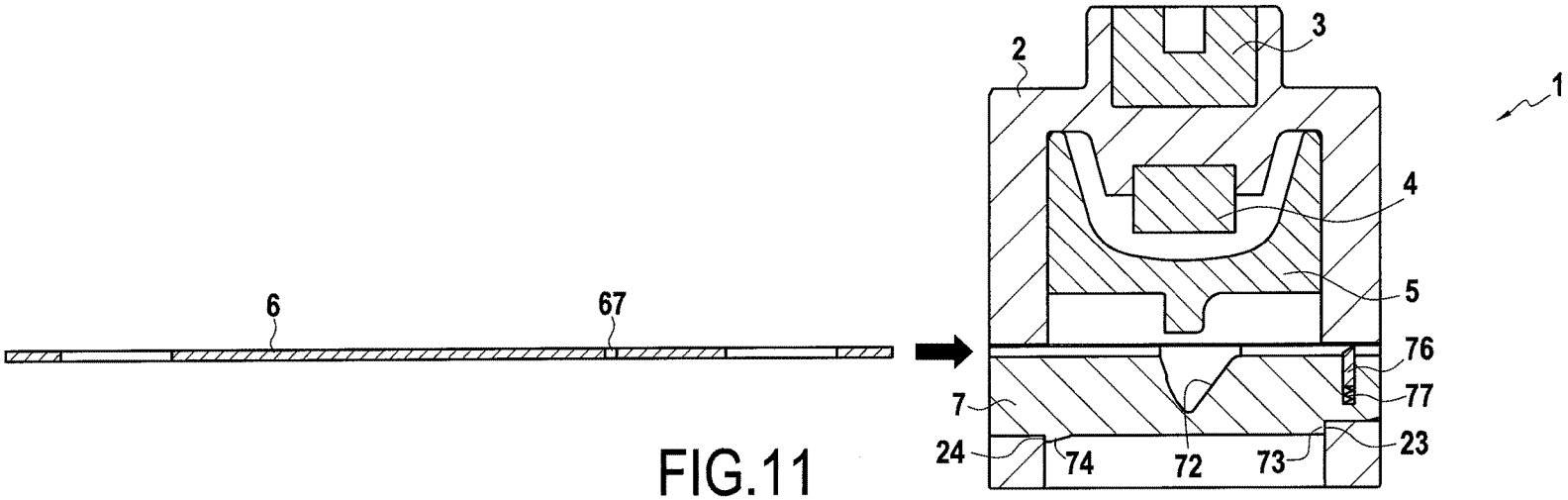

FIGS. 5 and 6 disclose two views of a pyrotechnic circuit breaker according to another aspect of the invention, respectively an assembled view and an exploded view;

FIGS. 7 and 8 are cross section views of the pyrotechnic circuit breaker disclosed in FIGS. 5 and 6;

FIG. 9 is a cross section view of the pyrotechnic circuit breaker disclosed in FIGS. 5 and 6 with a cut bus bar and an embodiment of locking means;

FIGS. 10 and 11 illustrate the steps of assembly of the drawer and the bus bar of the pyrotechnic circuit breaker disclosed in FIG. 9.

In the various figures, the common elements are identified using identical numeral references.

DETAILED DESCRIPTION

Figure 1:
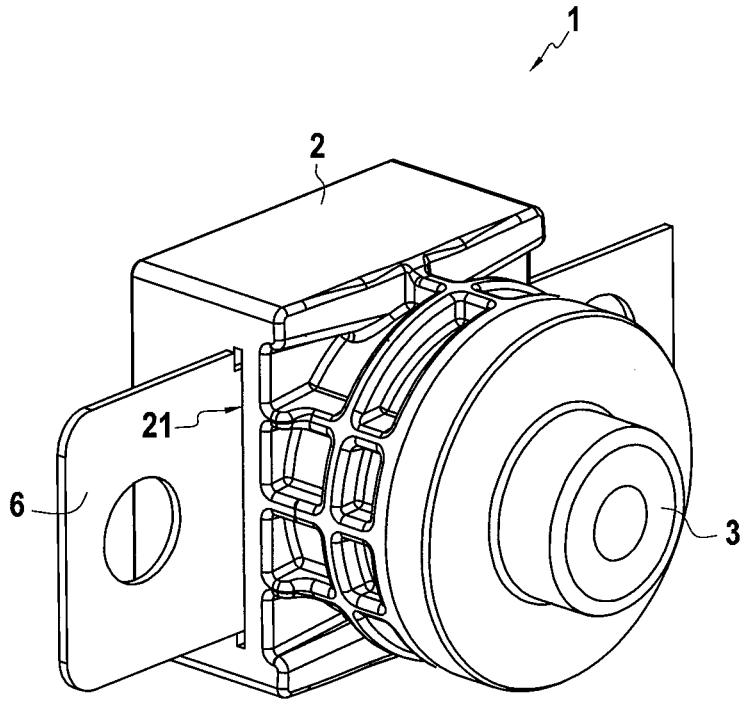
Figure 3:
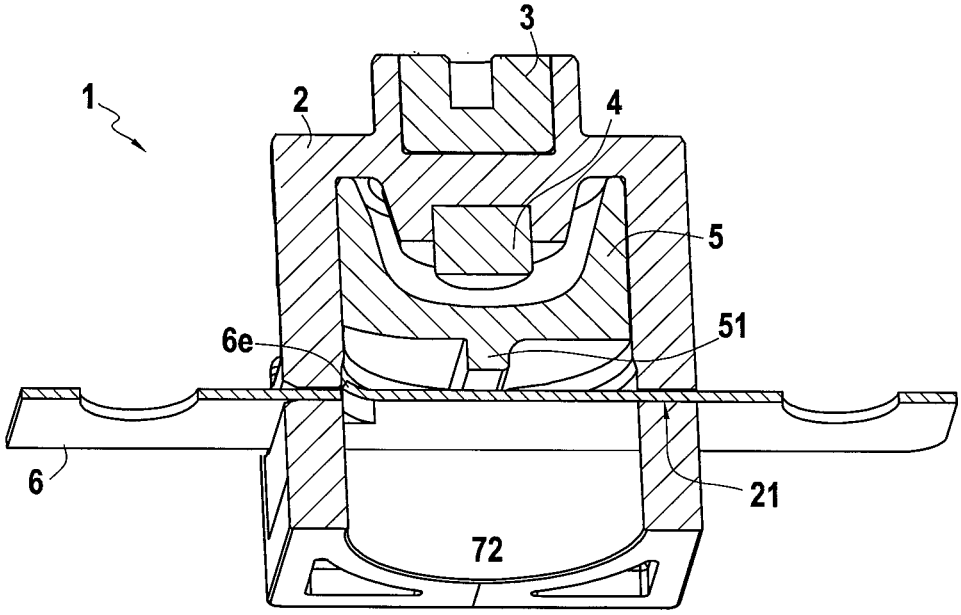
FIG. 3 is a cross section view of the pyrotechnic circuit breaker disclosed in FIGS. 1 and 2.
Figure 2:
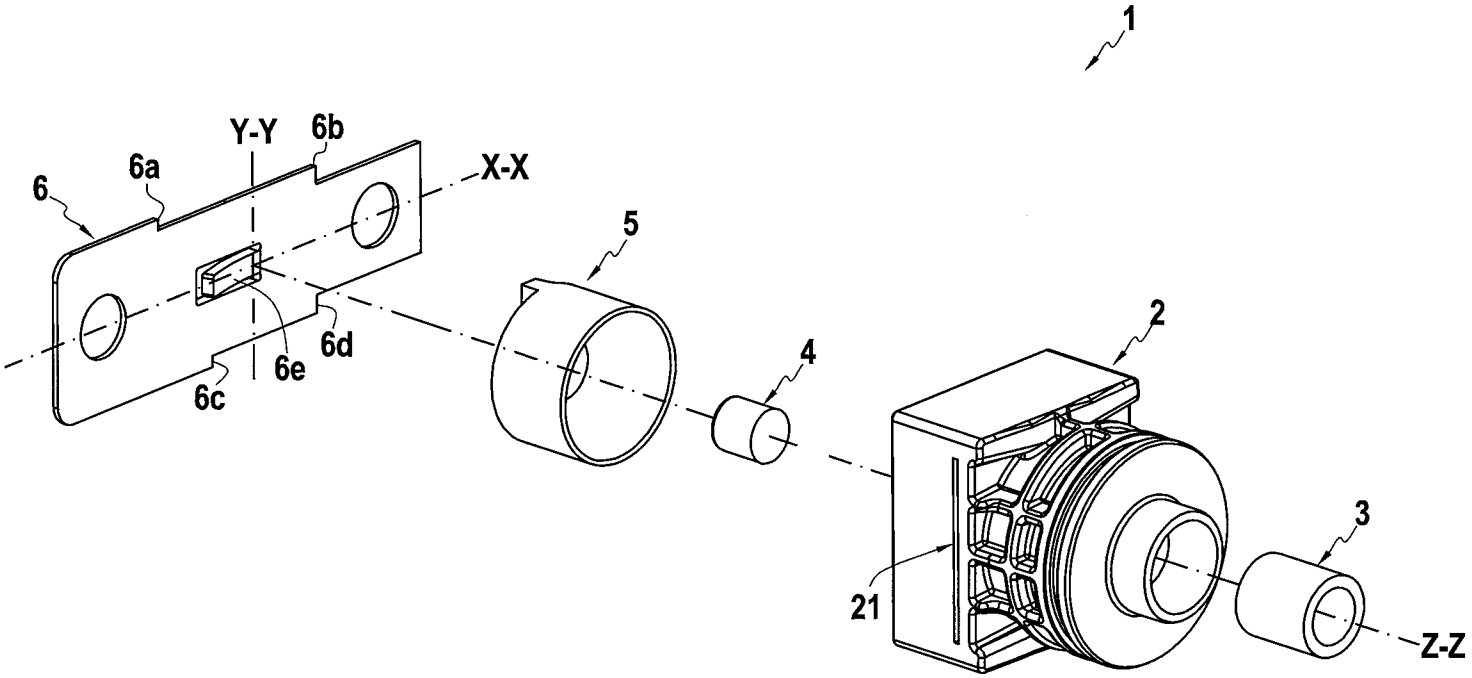

FIGS. 1 to 3 disclose various views of a pyrotechnic circuit breaker 1 according to an aspect of the invention.

The pyrotechnic circuit breaker 1 disclosed in the figures comprises a body 2,
a retainer 3
an igniter 4,
a piston 5, and
a bus bar 6.

The body 2 is adapted to accommodate the piston 5 and the igniter within an inner volume. The retainer 3 is typically positioned within a recess made in an outer surface of the body 2.

The piston 5 can move along a normal direction of the pyrotechnic circuit breaker 1, represented by the axis Z-Z on the drawings, between a raised position and a lowered position.

Figure 4:
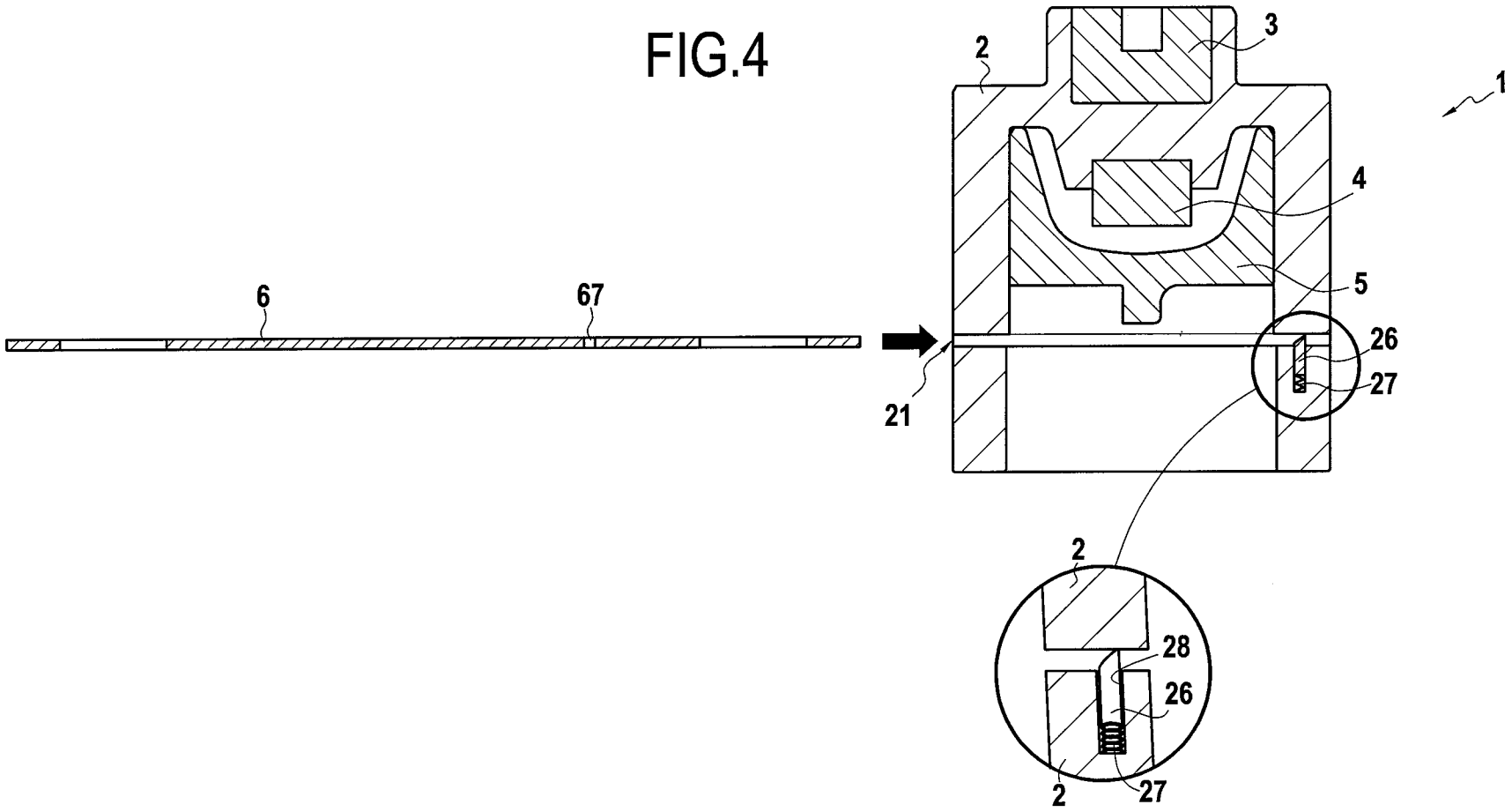
FIG. 4 illustrates the assembly of the bus bar within the body of the pyrotechnic circuit breaker.

As long as the igniter 4 has not been used, the piston 5 remains in its raised position, such as represented for instance in FIGS. 3 and 4.

Upon its actuation, the igniter 4 is configured to drive the piston 5 from its raised position to its lowered position as represented for instance in FIG. 5, where it separates the bus bar 6 into two distinct portions, that will arbitrarily be designated as a proximal portion and a distal portion, in order to break the electrical condition of the bus bar 6.

To achieve the cut of the bus bar, the piston 5 comprises a cutting edge 51, protruding from a lower face, and adapted to come into contact with the bus bar 6, in order to cut or break the bus bar 6 along a transverse direction Y-Y, perpendicular to the normal direction Z-Z along which the piston 5 moves.

The body comprises a longitudinal slot 21 that extends through its body, along a longitudinal direction X-X, perpendicular to the normal direction Z-Z along which the piston 5 translates.

This longitudinal slot 21 is adapted so that the bus bar 6 can be slidably inserted through the body 2, so as to protrude from two opposite sides of the body 2 in order to establish electric conduction through the body 2 by connecting an electric circuit to both ends of the bus bar 6 that protrude from the body 2.

FIG. 4 illustrates the insertion of the bus bar 6 within the longitudinal slot 21. As represented in this figure, the pyrotechnic circuit breaker 1 is assembled, with the exception of the bus bar 6. The bus bar is then slidably inserted through the longitudinal slot 21 of the body 2, so as to protrude from two opposite sides of the body 2, as represented in FIGS. 1 and 3 for instance.

The whole pyrotechnic circuit breaker 1 can therefore be assembled without the bus bar 6, which can then be slidably inserted within the body 2 in order to complete the device.

This enables to provide the bus bar 6 independently from the other components of the pyrotechnic circuit breaker 1, contrary to conventional pyrotechnic circuit breakers that are usually provided together with their associated bus bar, which is integrated within the body during its assembly.

The bus bar 6 and the body 2 typically comprise indexation means, so as to ensure a proper positioning of the bus bar 6 with respect to the body 2, and to maintain the bus bar 6 within the body 2 once inserted.

In the embodiment disclosed in FIG. 2, the indexation means of the bus bar 6 comprise notches 6*a*, 6*b*, 6*c*, 6*d* arranged on the sides of the bus bar 6, adapted to abut against corresponding surfaces of the body 2. These notches can be made asymmetrical, in order to define an unique way of inserting the bus bar 6 within the insertion slot, allowing to immobilize the bus bar in the direction of its insertion in the body 2

In the embodiment disclosed in the FIGS. 2 and 3, the indexation means comprise a central blade 6*e* arranged along the central longitudinal axis X-X of the bus bar 6 and adapted to abut against the internal opposing sides of the body 2, allowing to immobilize the bus bar in the opposite direction of its insertion in the body 2

The shape and the number of the said blade 6*e* can be modified and adapted to the design of the body 2.

In the embodiment disclosed in FIG. 4, the indexation means comprise a through hole 67 arranged within the bus bar 6, and a locating pin 26 coupled with a spring 27 and mounted in a recess 28 of the body 2. The indexation means can comprise multiple through holes 67 and/or locating pins 26 in order to reinforce the holding in position of the bus bar 6.

The locating pin 26 is configured so that during the insertion of the bus bar 6, the bus bar pushes the locating pin 26 back in the recess 28, and once the bus bar is in position where the through hole 67 is aligned with the locating pin 26, the locating pin 26 is pushed by the spring 27 out of the recess 28, and engages the through hole 67 of the bus bar 6, and therefore locks the bus bar 6 in position with respect to the body 2 of the pyrotechnic circuit breaker 1.

The locating pin 26 and the through hole 67 typically have a non-circular section, so that the locating pin 26 does not rotate during handling and assembly.

FIGS. 5 to 11 disclose various views of an alternative embodiment of a pyrotechnic circuit breaker 1 according to an aspect of the invention.

The pyrotechnic circuit breaker 1 disclosed in FIGS. 5 to 11 comprises a body 2,
a retainer 3
an igniter 4,
a piston 5,
a bus bar 6, and
a drawer 7.

As already described in reference to FIGS. 1 to 3, the body 2 is adapted to accommodate the piston 5 and the igniter within an inner volume. The retainer 3 is typically positioned within a recess made in an outer surface of the body 2.

The piston 5 can move along a normal direction of the pyrotechnic circuit breaker 1, represented by the axis Z-Z on the drawings, between a raised position and a lowered position.

As long as the igniter 4 has not been used, the piston 5 remains in its raised position, such as represented for instance in FIGS. 7 and 8.

Upon its actuation, the igniter 4 is configured to drive the piston 5 from its raised position to its lowered position as represented for instance in FIG. 9, where it separates the bus bar 6 into two distinct portions, that will arbitrarily be designated as a proximal portion and a distal portion, in order to break the electrical condition of the bus bar 6.

To achieve the cut of the bus bar, the piston 5 comprises a cutting edge 51, protruding from a lower face, and adapted to come into contact with the bus bar 6, in order to cut or break the bus bar 6 along a transverse direction Y-Y, perpendicular to the normal direction Z-Z along which the piston 5 moves.

The body comprises a longitudinal slot 21 that extends through its body, along a longitudinal direction X-X, perpendicular to the normal direction Z-Z along which the piston 5 translates.

In this embodiment, the pyrotechnic circuit breaker 1 comprises a drawer 7, configured to be inserted within the longitudinal slot 21 of the body 2, typically so as to fit within the body 2, and to define an insertion slot between the body 2 and the drawer 7, adapted to receive the bus bar 6.

In this embodiment, the longitudinal slot 21 therefore has greater dimensions than in the embodiment disclosed with respect to FIGS. 1 to 4, so as to accommodate both the drawer 7 and the bus bar 6.

FIGS. 10 and 11 illustrate the successive insertions of the drawer 7 and the bus bar 6 within the longitudinal slot 21 of the body 2.

As illustrated in FIG. 10, the drawer 7 is first inserted within the longitudinal slot 21 of the body 2, so that it is retained within the body, for instance by notches and/or indentations arranged on the drawer 7 and on the body 2.

In the illustrated embodiment, the drawer 7 comprises a notch 73 on one end which abuts against an insertion stop 23 of the body once the drawer 7 is fully inserted within the body 2, and a protrusion 74 which acts as anti-return means in order to prevent an involuntary removal of the drawer 7 once fully inserted within the body 2. This protrusion 74 abuts against a removal stop 24 of the body opposite the insertion stop 23 of the body 2.

The drawer 7 typically has a height which is less than the height of the longitudinal slot 21 thereby forming the insertion slot between the drawer 7 and the body 2, and also enabling to insert the drawer 7 within the longitudinal slot of the body 2 even though the drawer 7 comprises protrusions 74.

Other means can be used in order to maintain the drawer 7 within the body 2 once inserted, for instance flexible tongues or blades can be made in the drawer 7, and configured so that they are bent during insertion of the drawer 7 within the body 2, and extend within the body 2 once the drawer 7 is inserted to prevent the removal of the drawer 7.

Once the drawer 7 is fully inserted and maintained in position within the body 2, the drawer 7 and the body 2 define an insertion slot adapted to receive the bus bar 6.

The bus bar 6 is then slidably inserted in the insertion slot, as illustrated in FIG. 11, in order to be positioned through the body 2, as represented in FIGS. 5 and 7 for instance, so as to protrude from two opposite sides of the body 2.

In the same way as for the drawer 7, the bus bar 6 typically comprises indexation means, in order to lock its position with respect to the drawer 7 and the body 2 once inserted within the insertion slot.

These indexation means can either immobilize the bus bar 6 with respect to the drawer 7 and the body, or limit its displacement to a translation according to a single direction, opposite to the direction from which it was inserted within the insertion slot.

In the embodiment disclosed in FIG. 6, the indexation means of the bus bar 6 comprise notches 6*a*, 6*b*, 6*c*, 6*d* arranged on the sides of the bus bar 6, adapted to abut against corresponding surfaces of the body 2 and/or of the drawer 7. These notches can be made asymmetrical, in order to define an unique way of inserting the bus bar 6 within the insertion slot 2 allowing to immobilize the bus bar in the the direction of its insertion in the body 2

In the embodiment disclosed in the FIGS. 6 and 7, the indexation means comprise a central blade 6*e* arranged along the central longitudinal axis X-X of the bus bar 6 and adapted to abut against the internal opposing side of the body 2, allowing to immobilize the bus bar in the opposite direction of its insertion in the body 2

The shape and the number of the said blade 6*e* can be modified and adapted to the design of the body 2.

The drawer 7 can be adapted in order to modify the dimensions and shape of the insertion slot, and therefore enables to adapt the body 2 of the pyrotechnic circuit breaker to various types and shapes of bus bars 6.

The pyrotechnical circuit breaker 1 as disclosed can therefore be adapted to various types and shapes of bus bars 6, while only requiring the change of a single component, i.e. the drawer 7.

In the embodiment disclosed in FIGS. 9 to 11, the indexation means comprise a through hole 67 arranged within the bus bar 6, and a locating pin 76 coupled with a spring 77 and mounted in a recess 78 of the drawer 7. The indexation means can comprise multiple through holes 67 and/or locating pins 76 in order to reinforce the holding in position of the bus bar 6.

The locating pin 76 is configured so that during the insertion of the bus bar 6, the bus bar pushes the locating pin 76 back in the recess 78, and once the bus bar 6 is in position where the through hole 67 is aligned with the locating pin 76, the locating pin 76 is pushed by the spring 77 out of the recess 78, and engages the through hole 67 of the bus bar 6, and therefore locks the bus bar 6 in position with respect to the drawer 7 and to the body 2 of the pyrotechnic circuit breaker 1

The locating pin 76 and the through hole 67 typically have a non-circular section, so that the locating pin 76 does not rotate during handling and assembly.

As illustrated in the drawings, and more specifically in FIG. 9, the drawer 7 typically comprises a receiving groove 72 arranged along the transversal direction Y-Y, configured to receive the cut or broken portion of the bus bar 6, and to allow the movement of the cutting edge 51 of the piston 5 through the bus bar 6.

In the illustrated embodiment, the drawer comprises a receiving groove 72 having a triangular or globally triangular section. Upon its movement from the raised position to the lowered position, the cutting edge 51 of the piston 5 comes into contact with a transversal surface of the receiving groove 72 once the bus bar 6 is cut. The receiving groove 72 is typically configured so that once the piston 5 moves and reaches its lowered position its lowered position, the cutting edge 51 is in continuous contact with a surface of the receiving groove 72.

This continuous contact between the cutting edge 51 of the piston and the drawer 7 enables to isolate the two portions of the bus bar 6 from each other once it has been cut, and thereby improves the electrical insulation between these two portions of the bus bar 6 for reliably breaking the associated circuit. Such continuous contact between the piston 5 and the drawer 7 enables to shut down potential arching which can occur during bus bar opening between the two portions of the bus bar 6 once the bus bar 6 is cut.

The shape of the receiving groove 72 is typically adapted to be the negative or complementary of the shape of the cutting edge 51 of the piston 5, and can be provided with sealing means along one of its surfaces adapted to come in contact with the cutting edge 51 of the piston 5 to ensure a proper contact.

The invention claimed is:

1. A pyrotechnic circuit breaker, comprising a body, an igniter, a piston and a bus bar, wherein the piston and the bus bar are accommodated within the body, and wherein the piston comprises a cutting edge and is movable along a normal direction from a raised position to a lowered position to cut a portion of the bus bar, thereby separating the bus bar into two distinct portions in order to break the electrical conduction of the bus bar, wherein the body comprises a longitudinal slot arranged through a longitudinal direction of the body, perpendicular to the normal direction, wherein the bus bar can be slidably inserted within the longitudinal slot along the longitudinal direction of the body, characterized in that the pyrotechnic circuit breaker further comprises a drawer slidably inserted within the longitudinal slot of the body along the longitudinal direction of the body, so that once inserted in the body, the drawer and the body define an insertion slot through the body where the bus bar is slidably inserted.

2. The pyrotechnic circuit breaker of claim 1, wherein the drawer comprises a notch that abuts against an insertion stop of the body to prevent further displacement of the drawer once it is positioned within the longitudinal slot of the body.

3. The pyrotechnic circuit breaker of claim 1, wherein the drawer and the bus bar comprise notches and abutment surfaces that engage the bus bar and the drawer once inserted within the body.

4. The pyrotechnic circuit breaker of claim 1, wherein the drawer comprises a receiving groove, which allows the movement of the cutting edge of the piston through the bus bar up to a lowered position of the piston where the cutting edge of the piston is in continuous contact with a surface of the receiving groove.

5. The pyrotechnic circuit breaker of claim 4, wherein said receiving groove has a triangular shape defining two transversal surfaces of the receiving groove, so that the cutting edge of the piston comes into continuous contact with one of these transversal surfaces when the piston is in its lowered position.

6. The pyrotechnic circuit breaker of claim 4, wherein said receiving groove has a surface which shape is complementary to the shape of the cutting edge of the piston.

7. The pyrotechnic circuit breaker of claim 1, wherein the bus bar comprises notches and abutment surfaces that prevent further displacement once it is positioned within the longitudinal slot of the body.

* * * * *